US006158843A

United States Patent [19]

Murthy et al.

[11] Patent Number: 6,158,843

[45] Date of Patent: Dec. 12, 2000

[54] INK JET PRINTER NOZZLE PLATES WITH INK FILTERING PROJECTIONS

[75] Inventors: Ashok Murthy; Steven Robert Komplin; Robert Wilson Cornell; James Harold Powers; Bruce David Gibson, all of Lexington, Ky.

[73] Assignee: Lexmark International, Inc., Lexington, Ky.

[21] Appl. No.: 08/827,242

[22] Filed: Mar. 28, 1997

[51] Int. Cl.[7] ..... B41J 2/14; B41J 2/05

[52] U.S. Cl. ..... 347/47; 347/56

[58] Field of Search ..... 347/47, 56, 65, 347/44, 61

[56] References Cited

U.S. PATENT DOCUMENTS

| | | | |
|---|---|---|---|
| 3,549,733 | 12/1970 | Caddell | 264/400 |
| 4,044,222 | 8/1977 | Kestenbaum | 219/121.71 |
| 4,164,745 | 8/1979 | Cielo et al. | 347/61 |
| 4,216,477 | 8/1980 | Matsuda et al. | 346/45 X |
| 4,258,468 | 3/1981 | Balde | 29/830 |
| 4,317,124 | 2/1982 | Shirato et al. | 347/67 |
| 4,426,253 | 1/1984 | Kreuz et al. | 216/83 |
| 4,472,238 | 9/1984 | Johnson | 216/18 |
| 4,508,749 | 4/1985 | Brannon et al. | 427/555 |
| 4,568,632 | 2/1986 | Blum et al. | 430/322 |
| 4,587,534 | 5/1986 | Saito et al. | 347/56 |
| 4,635,358 | 1/1987 | Fritz | 29/853 |
| 4,642,160 | 2/1987 | Burgess | 216/18 |
| 4,683,481 | 7/1987 | Johnson | 347/65 |
| 4,714,516 | 12/1987 | Eichelberger et al. | 216/62 |
| 4,746,935 | 5/1988 | Allen | 347/98 |
| 4,827,328 | 5/1989 | Ozawa et al. | 361/765 |
| 4,829,319 | 5/1989 | Chan et al. | 347/47 |
| 4,882,595 | 11/1989 | Trueba et al. | 347/85 |
| 4,894,115 | 1/1990 | Eichelberger et al. | 134/1.1 |
| 4,940,881 | 7/1990 | Sheets | 219/121.69 |
| 4,959,199 | 9/1990 | Lantzer | 422/300 |
| 4,967,208 | 10/1990 | Childers | 347/56 |
| 5,061,840 | 10/1991 | Portney et al. | 219/121.68 |
| 5,063,280 | 11/1991 | Inagawa et al. | 219/121.7 |
| 5,119,116 | 6/1992 | Yu | 347/65 |
| 5,198,834 | 3/1993 | Childers et al. | 347/65 |
| 5,208,604 | 5/1993 | Watanabe et al. | 347/47 |
| 5,229,785 | 7/1993 | Leban | 347/47 |
| 5,291,226 | 3/1994 | Schantz et al. | 347/47 X |
| 5,305,015 | 4/1994 | Schantz et al. | 347/47 |
| 5,305,018 | 4/1994 | Schantz et al. | 347/47 |
| 5,312,517 | 5/1994 | Ouki | 216/27 |
| 5,387,314 | 2/1995 | Baughman et al. | 216/27 |
| 5,417,897 | 5/1995 | Asakawa et al. | 264/400 |
| 5,463,413 | 10/1995 | Ho et al. | 347/65 |
| 5,467,115 | 11/1995 | Childers . | |
| 5,467,118 | 11/1995 | Gragg et al. | 347/87 |
| 5,484,507 | 1/1996 | Ames | 347/47 X |
| 5,495,665 | 3/1996 | Carpenter et al. | 29/830 |
| 5,506,608 | 4/1996 | Marler et al. | 347/18 |
| 5,818,478 | 10/1998 | Gibson | 347/47 X |
| 5,907,333 | 5/1999 | Patil et al. | 347/65 X |
| 6,045,214 | 4/2000 | Murthy et al. | 347/47 |

FOREIGN PATENT DOCUMENTS

| | | |
|---|---|---|
| 0 309 146 | 3/1989 | European Pat. Off. . |
| 0 471 157 | 2/1992 | European Pat. Off. . |
| 0 624 471 | 8/1992 | European Pat. Off. . |
| 0 627 318 | 12/1994 | European Pat. Off. . |
| 0 720 035 | 7/1996 | European Pat. Off. . |
| 0 761 448 | 8/1996 | European Pat. Off. . |
| 2-249652 | 10/1990 | Japan . |
| 2-263562 | 10/1990 | Japan . |
| 3-169559 | 7/1991 | Japan . |
| 3-277554 | 12/1991 | Japan . |

(List continued on next page.)

*Primary Examiner*—Susan S. Y. Lee
*Attorney, Agent, or Firm*—Michael T. Sanderson; Luedeka, Neely & Graham

[57] ABSTRACT

A nozzle plate for a printhead of a thermal inkjet printer having a thickness sufficient to provide a plurality of nozzle holes above a plurality of firing chambers. Ink supply channels, for feeding ink to the firing chambers, are connected to an ink supply region and the nozzle plate has a plurality of projections sufficient to filter ink entering the supply channels from the supply region.

9 Claims, 3 Drawing Sheets

FOREIGN PATENT DOCUMENTS

| | | |
|---|---|---|
| 4-14458 | 1/1992 | Japan . |
| 4-107149 | 4/1992 | Japan . |
| 4-131244 | 5/1992 | Japan . |
| 4-176655 | 6/1992 | Japan . |
| 4-216946 | 8/1992 | Japan . |
| 4-235048 | 8/1992 | Japan . |
| 4-279355 | 10/1992 | Japan . |
| 6-15829 | 1/1994 | Japan . |
| 6-79874 | 5/1994 | Japan . |
| 6-183008 | 7/1994 | Japan . |
| 7-195697 | 8/1995 | Japan . |
| WO93 15911 | 8/1992 | WIPO . |
| WO92 16822 | 10/1992 | WIPO . |

INK JET PRINTER NOZZLE PLATES WITH INK FILTERING PROJECTIONS

FIELD OF THE INVENTION

The invention relates to ink jet nozzle plates having improved flow characteristics and to methods for making the nozzle plates for ink jet printers.

BACKGROUND

Printheads for ink jet printers are precisely manufactured so that the components cooperate with an integral ink reservoir to deliver ink to an ink ejection device in the printhead to achieve a desired print quality. A major component of the printhead of an ink jet printer is the nozzle plate which contains ink supply channels, firing chambers and ports for expelling ink from the printhead.

Since the introduction of ink jet printers, nozzle plates have undergone considerable design changes in order to increase the efficiency of ink ejection and to decrease their manufacturing cost. Changes in the nozzle plate design continue to be made in an attempt to accommodate higher speed printing and higher resolution of the printed images.

Nozzle plates are complex structures which contain multiple ejection ports or nozzles for ejecting ink and channels for feeding ink from an ink reservoir to a firing chamber associated with the nozzle being used. Pressure is created in the firing chamber to expel a droplet of ink from the chamber through the nozzle to the substrate. The pressure also forces ink out of the supply channel and may affect the ink in the supply region or via feeding other supply channels and firing chambers.

Thermal ink jet printers use a plurality of resistance heating elements in the firing chambers to vaporize a component of the ink which then expands as a vapor bubble forcing ink out of the nozzle associated with the chamber. As the ink/vapor interface cools, the bubble begins to contract and finally collapses onto the heater surface. As the bubble collapses, the chamber refills by capillary action. As the chamber refills, the ink forms a meniscus which undergoes an oscillatory motion. The oscillatory motion of the meniscus tends to pull a small amount of air into the firing chamber and under certain conditions, the air may be trapped in the chamber. Trapped air may accumulate in the chamber after a number of firings. Once this happens, the performance of the nozzle degrades severely. Trapped air also act as a shock absorber which reduces the pumping action of the vapor bubble. If too much air is trapped in the firing chamber, it may push ink out of the ink supply channel or choke off the inlet of the channel thereby affecting the ability to refill the chamber. In addition to trapped air, debris in the ink may also effect the refilling of the firing chambers and thus the quality and efficiency of the ink ejected from the nozzles.

Methods for controlling the fluid refill rate of the firing chambers for an ink jet printhead are described in U.S. Pat. No. 4,882,595 to Trueba et al. As described in the '595 patent, cross-talk between the firing chambers may affect print speed and/or print quality. One method to reduce cross-talk is resistive decoupling which uses fluid friction present in the ink feed channel to dissipate energy associated with cross-talk surges. Another method uses inertial decoupling wherein long, slender feed channels are said to maximize the inertial aspect of the fluid entrance within the channels. However, both resistive decoupling and inertial decoupling were found to result in a longer settling time between firings of the nozzle. Another proposed solution to the problem was the use of localized constriction or a lumped resistance element at the entrance of the feed channel. Despite such proposals there continues to be a need for nozzle plate designs which improve the flow characteristics and refill speed of ink to the firing chambers.

It is an object of this invention, therefore, to provide improved nozzle plates for ink jet printheads.

It is another object of this invention to provide a method for reducing the interference between firing chambers of a thermal ink jet printhead.

It is a further object of this invention to provide nozzle plates for ink jet printers which possess improved ink flow characteristics under various operating conditions.

Still another object of the invention is to provide a method for manufacturing nozzle plates for ink jet printers.

A further object of the invention is to provide a method for laser ablating nozzle plates having improved ink flow characteristics.

SUMMARY OF THE INVENTION

With regard to the above and other objects and advantages, the invention provides a polymeric nozzle plate for a thermal ink jet printer which is comprised of a polymeric material having a thickness sufficient to provide a plurality of firing chambers disposed adjacent opposed edges of the nozzle plate, nozzle holes above each firing chamber and ink supply channels for feeding the firing chambers which are connected to an ink supply region. Each of the firing chambers have a firing chamber height, each of the supply channels have a supply channel height and the supply region has a supply region height which heights are a fraction of the thickness of the polymeric material.

In another aspect the invention provides a method for making a nozzle plate for an ink jet printer which comprises mounting a polyimide film on a movable platen, ablating firing chambers and ink supply channels associated with the firing chambers while controlling the defocus of the laser beam with respect to the polyimide material in order to form the nozzle holes and firing chambers in the polyimide film.

In yet another aspect, the invention provides a mask for ablating a polymeric material which comprises a laser beam resistant web having regions of varying opacity from opaque to transparent containing semitransparent regions for formation of an ink supply region, a plurality of ink supply channels connected to the ink supply region and firing chambers associated with each ink supply channels. The mask also contains transparent regions for formation of nozzle holes in semi-transparent regions used to form the firing chambers wherein the opaque regions define the boundaries of the firing chambers, ink supply channels and ink supply region and are substantially on a periphery of the mask.

The apparatus and methods of the invention provide improved ink jet nozzle plates which reduce problems associated with ink flow to the firing chambers and which substantially reduce manufacturing costs by simplifying the manufacturing steps. Because the nozzle holes, firing chambers and ink supply channels are all formed in the same polymeric material, alignment of separate polymeric or thick film materials containing the firing chambers and nozzles holes is not required. Also, using a mask having varying opacity to form the flow features in the same polymeric material reduces the need for using multiple masks and separate alignment steps for each mask.

BRIEF DESCRIPTION OF THE DRAWINGS

The above and other features and advantages of the invention will now be described in the following detailed description of preferred embodiments in conjunction with the drawings and appended claims wherein:

DETAILED DESCRIPTION OF PREFERRED EMBODIMENTS

Figure 1:
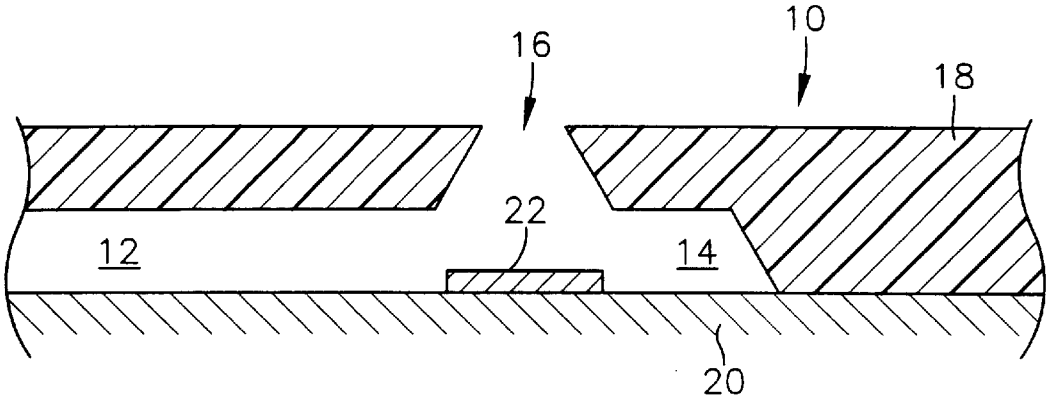
FIG. 1 is a cross-sectional view not to scale though an ink supply channel, firing chamber and nozzle hole of a nozzle plate of the invention.

The invention provides improved nozzle plates and methods and apparatus for making the nozzle plates. In particular, the invention provides a nozzle plate made from a polymeric material selected from the group consisting of polyimide polymers, polyester polymers, polymethyl methacrylate polymers, polycarbonate polymers and homopolymers, copolymers and terpolymers as well as blends of two or more of the foregoing, preferably polyimide polymers, which has a thickness sufficient to contain firing chambers, ink supply channels for feeding the firing chambers and nozzles holes associated with the firing chambers. It is preferred that the polymeric material have a thickness of about 10 to about 300 microns, preferably a thickness of about 15 to about 250 microns, most preferably a thickness of about 35 to about 75 microns and including all ranges subsumed therein. For the purpose of simplifying the description, the firing chambers and supply channels are referred to collectively as the "flow features" of the nozzle plates.

Each nozzle plate contains a plurality of ink supply channels, firing chambers and nozzles holes which are positioned in the polymeric material so that the nozzle holes are associated with an ink propulsion device so that upon activation of the firing chamber a droplet of ink is expelled from the firing chamber through the nozzle hole to a substrate to be printed. Sequencing one or more firing chambers in rapid succession provides ink dots on the substrate which when combined with one another produce an image.

The nozzle plates may be formed in a continuous or semi-continuous process by laser machining a polymeric material which is provided as a continuous elongate strip or film. To aid in handling and providing for positive transport of the elongate strip of polymeric material through the manufacturing steps, sprocket holes or apertures are provided in the strip along one or both sides thereof.

The strip of material in which the nozzle plate is formed is conventionally provided on a reel. Several manufacturers, such as UBE of Japan and E.I. DuPont de Nemours & Co. of Wilmington, Del., commercially supply materials suitable for use in manufacturing the nozzle plates, under the trademarks of UPILEX or KAPTON, respectively. The preferred material for use in making nozzle plates is a polyimide tape containing an adhesive layer on one surface thereof.

The adhesive layer (not shown) is preferably any B-stageable material. Examples of suitable B-stageable materials are thermal cure resins which include phenolic resins, resorcinol resins, urea resins, epoxy resins, ethylene-urea resins, furane resins, polyurethanes, and silicon containing resins. Thermoplastic or hot melt materials which may be used as an adhesive include ethylene-vinyl acetate, ethylene ethylacrylate, polypropylene, polystyrene, polyamides, polyesters and polyurethanes. The adhesive layer is typically about 1 to about 100 microns in thickness, preferably about 1 to about 50 microns in thickness and most preferably about 5 to about 20 microns in thickness. In the most preferred embodiment, the adhesive layer is a phenolic butyral adhesive such as that used in the laminate RFLEX R1100 or RFLEX R1000, commercially available from Rogers of Chandler, Ariz.

The adhesive layer is preferably coated with a sacrificial layer, preferably a water soluble polymer such as polyvinyl alcohol which remains on the adhesive layer until the laser ablation of the flow features in the nozzle plate is substantially complete. Commercially available polyvinyl alcohol materials which may be used as the sacrificial layer include AIRVOL 165, available from Air Products Inc. of Allentown, Pa., EMS1146 from Emulsitone Inc. of Whippany, N.J., and various polyvinyl alcohol resins from Aldrich Chemical Company of Milwaukee, Wis. The sacrificial layer is preferably at least about 1 micron in thickness and is coated onto the adhesive layer which is on the polymeric film.

Methods such as extrusion, roll coating, brushing, blade coating, spraying, dipping, and other techniques known to the coatings industry may be used to coat the polymeric material with the adhesive and sacrificial layer. After machining the polymeric material to form the flow features therein, the sacrificial layer is be removed by dipping or spraying the polymeric material with a solvent such as water.

Figure 2:
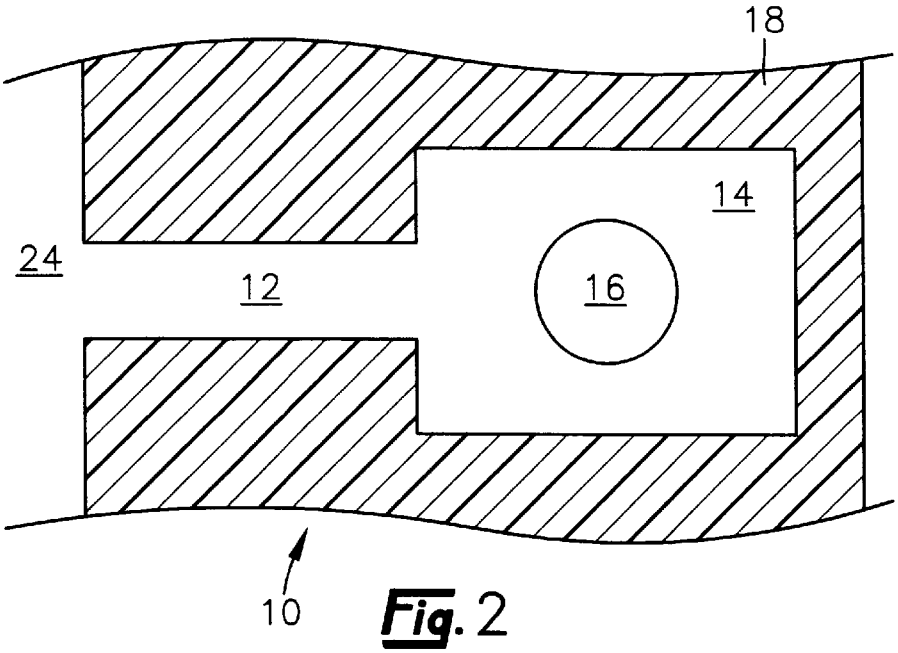
FIG. 2 is a plan view not to scale of an ink supply channel, firing chamber and nozzle hole of a nozzle plate of the invention.

Various aspects of the design of the nozzle plates and the impact of the design on their operation will be understood by referring to the drawings. Accordingly, FIG. 1 is a cross-sectional view not to scale of a nozzle plate 10 of the invention as seen through an ink supply channel 12, a firing chamber 14 and a nozzle hole 16. FIG. 2 is a plan view, not to scale, of the ink supply channel 12, firing chamber 14 and nozzle hole 16 formed in the polymeric material 18. A plurality of supply channels 12, firing chambers 14 and nozzle holes 16 are provided in a polymeric material 18, preferably by the laser machining techniques which will be described in more detail below.

Once the flow features and nozzle holes 16 are formed in the polymeric material 18, the nozzle plate 10 is attached to a semi-conductor substrate 20 containing an ink propulsion device 22 such as a resister for heating the ink in the firing chamber 14 (FIG. 1). When the ink is heated with a resister-type propulsion device 22, a component in the ink vaporizes rapidly producing a vapor bubble which forms in the firing chamber 14 which forces a portion of ink from the firing chamber through the nozzle hole 16 so that it impacts on a substrate. Because the vapor bubble expands rapidly in all directions, it also forces ink out of the supply channel 12.

Prior to attaching the nozzle plate to the substrate, it is preferred to coat the substrate with a thin layer of photocurable epoxy resin to enhance the adhesion between the nozzle plate and the substrate and to fill in all topographical features on the surface of the chip. The photocurable epoxy resin is spun onto the substrate, photocured in a pattern which define the supply channels 12 and the firing chambers 14 and the ink supply region 24. A preferred photocurable epoxy formulation comprises from about 50 to about 75% by weight -butyrolactone, from about 10 to about 20% by weight polymethyl methacrylate-co-methacrylic acid, from about 10 to about 20% by weight difunctional epoxy resin such as EPON 1001F commercially available from Shell Chemical Company of Houston, Tex., from about 0.5 to about 3.0% by weight multifunctional epoxy resin such as DEN 431 commercially available from Dow Chemical Company of Midland Mich., from about 2 to about 6% by weight photoinitiator such as CYRACURE UVI-6974 commercially available from Union Carbide Corporation of Danbury and from about 0.1 to about 1% by weight gamma glycidoxypropyltrimethoxy-silane.

As the ink in the firing chamber 14 cools, the vapor bubble collapses. Ink is drawn back into the supply channel 12 and firing chamber 14 from the ink supply region 24 by a combination of bubble collapse and capillary action in the supply channel 12. Once the firing chamber 14 has been refilled, it is again ready to expel ink from the nozzle 16. The time between when ink has been expelled from the firing chamber and when the firing chamber has been refilled is referred to as the "settling time."

Figure 3:
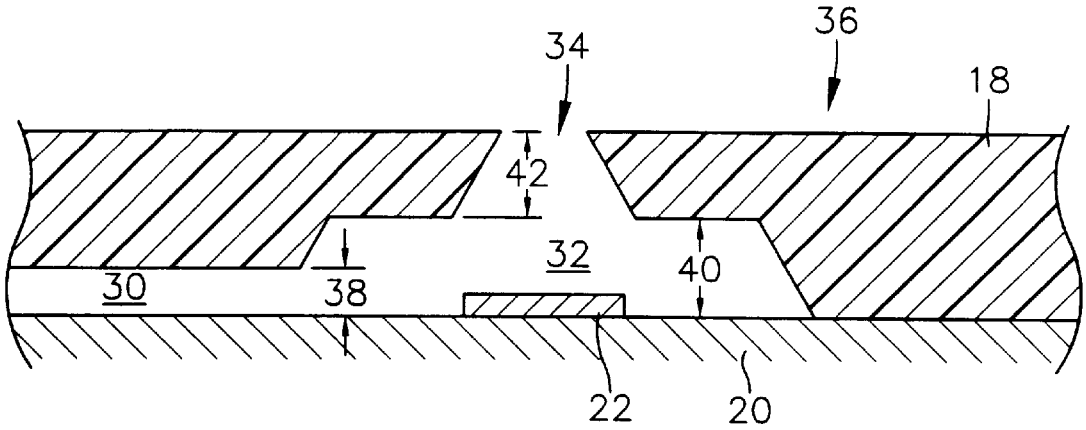
FIGS. 3, 4 and 5 are an cross-section views of alternative configurations of ink supply channels, firing chambers and nozzle holes of a nozzle plate of the invention.

The nozzle plates of the invention contain flow features which enable the firing chambers 14 and supply channels 12 to be independently designed to optimize printer performance and which reduce air and debris blockages in the supply channels 12 as well as decrease the settling time between chamber firings. FIG. 3 illustrates in cross-section through a supply channel 30, firing chamber 32 and nozzle hole 34, the configuration of a nozzle plate 236 which enables the design of the firing chamber 32 to be optimized independently of the supply channel 30. As shown by the nozzle plate illustrated by FIG. 3, the height 38 of the supply channel 30 is substantially less than the height 40 of the firing chamber, preferably from about 0.2 to about 4.0 times the height 40 of the firing chamber 32.

Figure 4:
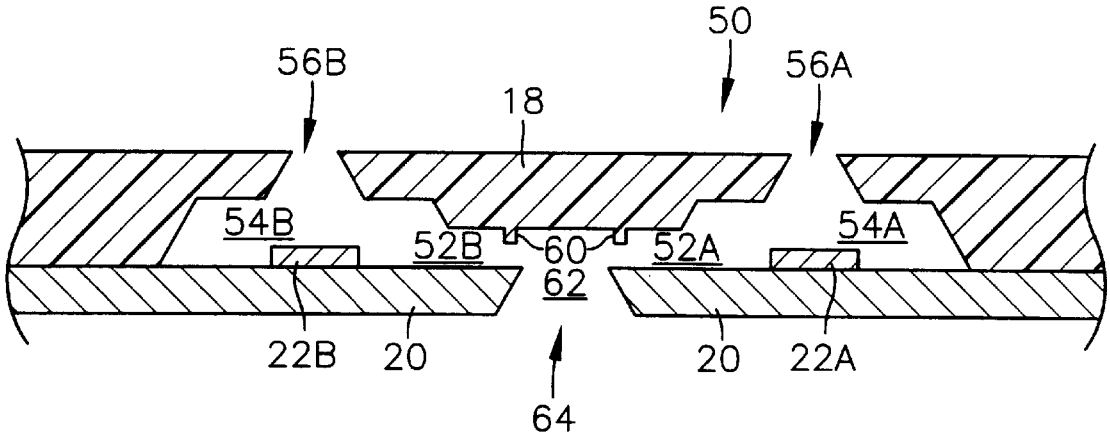

FIG. 4 illustrates an alternative nozzle plate design which combines the features of reduced supply channel height with a means for trapping debris so that debris does not enter and block the supply channels. As illustrated in FIG. 4, the nozzle plate 50, as seen in cross section cutting through two ink supply channels 52A and 52B, two firing chambers 54A and 54B, two resistor-type propulsion devices 22A and 22B, and two nozzle holes 56A and 56B, contains projections 60 in the ink supply region 62 which extend into the supply channels 52A and 52B a portion of the distance from the polymeric material 18 to the semiconductor substrate 20. Accordingly, as debris or other foreign matter enter the supply region 62 from the ink via 64 in the substrate 20, the projections 60 block the debris from entering the ink supply channels 52A and 52B. Hence, the design shown in Fib. 4 not only decouples the design of the firing chambers 54A and 54B from that of the nozzles holes 56A and 56B, but also acts to trap foreign matter before it enter and blocks the supply channels 52A and 52B.

Figure 5:
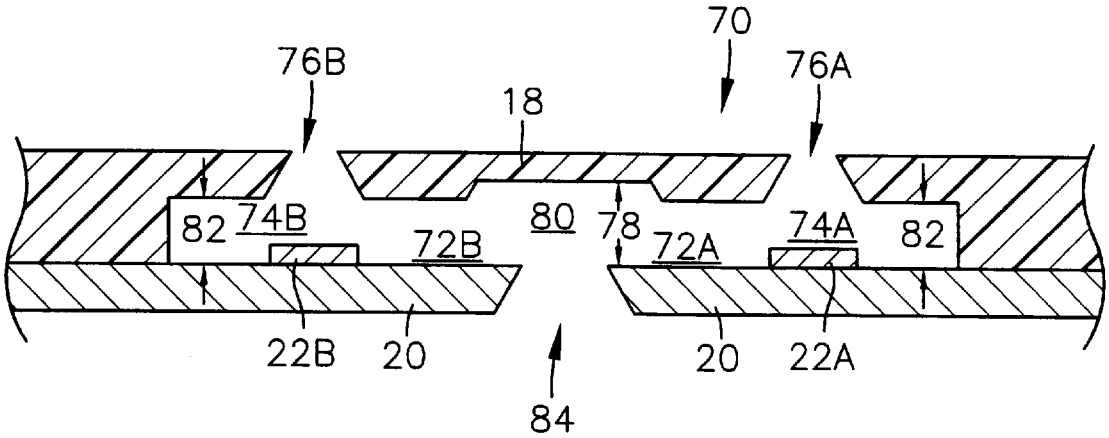

Another aspect of the invention is shown in FIG. 5. FIG. 5 is a cross sectional view of a nozzle plate 70 through two supply channels 72A and 72B, two resistor-type propulsion devices 22A and 22B, two firing chambers 74A and 74B and two nozzle holes 76A and 76B. In the nozzle plate design illustrated in FIG. 5, the distance 78 between the polymeric material 18 and the semiconductor substrate 20 in the ink supply region 80 has been increased so that the ink supply region 80 has a height 78 which is greater than the height 82 of the ink supply channels 72A and 72B of the firing chambers 74A and 74B. Because the distance 78 is greater than the height of the ink supply channels 72A and 72B, the fluidic inertance in the ink supply region 80 is reduced thereby increasing the flow of ink from the ink via 84 to the ink supply channels 72A and 72 B and firing chambers 74A and 74B. Hence, the period of time, known as settling time, which must elapse between successive firing of the same firing chamber is reduced to less than about 150 microseconds, preferably about 50 to about 130 microseconds, most preferably about 80 to about 125 microseconds, including all ranges subsumed therein.

Alternatively, the nozzle plate of FIG. 5 may also contain one or both of the features of the nozzle plates shown in FIGS. 3 and 4 as described above. Accordingly, the height of the supply channels 72A and 72B may be less than height of the firing chambers 74A and 74B as shown in FIG. 3 and/or the polymeric material 18 may contain projections which extend into the supply channels 72A and 72B a portion of the distance from the polymeric material 18 to the semiconductor substrate 20.

Figure 6:
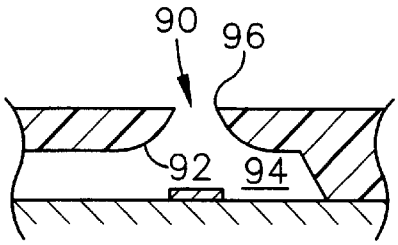
FIGS. 6 and 7 are a cross-sectional views, not to scale through nozzle holes and firing chambers of nozzle plates of the invention illustrating alternative designs for the nozzle holes.
Figure 7:
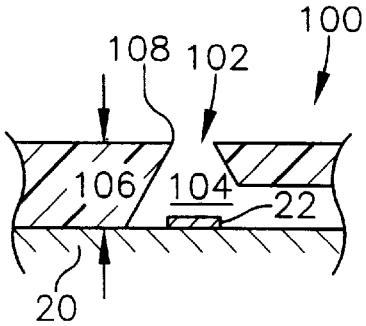

Various nozzle holes designs are illustrated in FIGS. 6 and 7 and may be used with any of the foregoing nozzle plates. As shown in FIG. 6, the nozzle hole 90 may have a substantially bell shaped configuration with the wider portion 92 of the hole 90 facing the firing chamber 94 so that there is a smooth transition from the firing chamber 94 to the exit 96 of the nozzle hole 90. Because the nozzle hole 90 does not have a sharp transition between the firing chamber 94 and the exit 96 of the hole 90, ink ejected from the nozzle hole has an improved flow pattern.

In FIG. 7, the nozzle plate 100 contains nozzle holes 102 and firing chambers 104 which also do not have a sharp transition between the nozzle hole 102 and the firing chamber 104. In this embodiment, the nozzle hole 102 and firing chamber 104 have a frustum conical shape for the entire distance 106 between the semiconductor substrate 20 and the exit 108 of the nozzle hole 102. The conical shape of the nozzle hole 102 and firing chamber 104 reduces the trapping of air in the firing chamber by eliminating the sharp boundary between the firing chamber 104 and nozzle hole 102. The shape also provides better ink flow in the chamber and out through the nozzle hole 102 by eliminating dead zones in the firing chamber 104 thereby decreasing the likelihood of air remaining in the firing chamber area. The conical shape also reduce air ingestion by increasing meniscus damping of the oscillations caused by bubble formation and vapor bubble collapse in the firing chamber 104.

Figure 8:
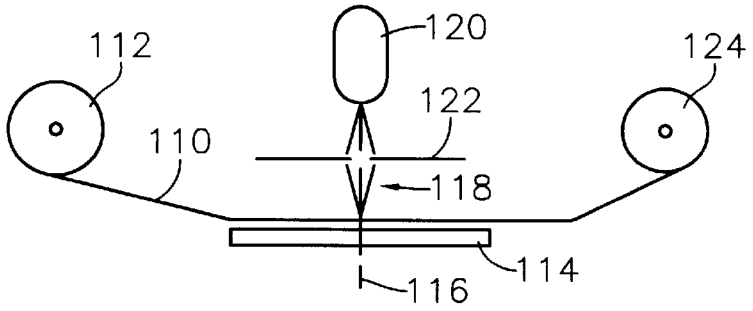
FIG. 8 is a schematic representation of a laser process for ablating a polymeric material to form nozzle plates according to the invention.

Various methods may be used to form the nozzle plates of the invention. The methods may include the use of a single mask or multiple masks and methods for controlling the laser radiation energy impacted on the polymeric material. In order to produce the nozzle hole shapes illustrated in FIGS. 6 and 7, a defocusing technique is preferably used. In a particularly preferred defocusing technique, illustrated in FIG. 8, a polymeric material 110 to be ablated in the form of a film is unrolled from a supply reel 112 onto a platen 114. The platen 114 is movable in a vertical direction along an axis 116 of a laser beam 118 emitted from a laser source 120. A mask 122 containing the flow features to be formed in the polymeric material 110 is placed in the path of the laser beam 118 so that the features as described above are formed. After ablating the flow features in the polymeric material 110, the material is rewound on a product reel 124 for further processing.

Initially, the laser beam is focused at a point which is plus or minus about 50 microns, preferably plus or minus about 30 microns and most preferably plus or minus about 10 microns within the top surface of the polymeric material 110. As the material is ablated, the platen is moved in a vertical direction toward the laser 120 along laser beam axis 118 in order to control the defocus of the beam 118.

By moving the platen 114 vertically, along the axis 116 of the laser beam 118 at the same time the laser 120 is being fired, the wall angle of the nozzle holes formed in the polymeric material is gradually varied between smaller angles measured from the horizontal plane perpendicular to the laser beam axis 1 16 and larger hole diameters for large values of beam defocus to smaller hole diameters and larger angles measured from the horizontal plane perpendicular to the laser beam axis 116 for more focused laser beams. By altering the relationship between laser firings and platen movement, nozzle holes having bell shapes or frustum conical shapes or a combination of bell and/or conical shapes may be made.

A laser which may be used to create flow features in the polymeric material to form the nozzle plates using the above described masks may be selected from an $F_2$, ArF, KrCI, KrF, or XeCI excimer or a frequency multiplied YAG laser. Laser ablation of the polymeric material is achieved at a power of from about 100 millijoules per centimeter squared to about 5,000 millijoules per centimeter squared, preferably from about 150 to about 1,500 millijoules per centimeter squared, and most preferably from about 700 to about 900 millijoules per centimeter squared including all ranges subsumed therein. During the laser ablation process, a laser beam having a wavelength of from about 150 nanometers to about 400 nanometers and most preferably from about 280 to about 330 nanometers is applied in pulses lasting from about one nanosecond to about 200 nanoseconds and most preferably about 20 nanoseconds.

Specific flow features of the nozzle plate are formed by applying a predetermined number of pulses of the laser beam through the mask. Many energy pulses may be required in those portions of the polymeric material from which a greater cross-sectional depth of material is removed, such as the nozzles holes, and fewer energy pulses may be required in those portions of the polymeric material which require only a portion of the material be removed from the cross-sectional depth of the material, such as the firing chambers and ink supply channels.

In one aspect of this invention, the platen can be fixed and the image plane produced by the imaging optics in the laser tool is varied in the vertical/Z-axis.

In another aspect, the imaging optics in the laser tool is fixed, and the platen is moved in the vertical axis via a motor. Therefore, the relative motions of the platen and image plane will determine the features ablated in the polymeric material.

In an illustrative example of the ablation process, the image plane was coplanar with the top surface of the polymeric material. As the laser was fired, the platen was moved up to shorten the distance between the laser and the polymeric material along the optical path. While there is no limitation, generally, with respect to the number of shots fired and the distance the platen is moved, a typical example often includes about 300 shots fired by the laser and platen movement of about 60 microns.

In view of this, the nozzle plates of this invention may be employed on any substrate capable of being used in an ink jet printer.

Moreover, the nozzle plates and substrates can result in an ink jet printhead capable of distributing ink to the firing chambers from the side or the center of the substrate.

Figure 9:
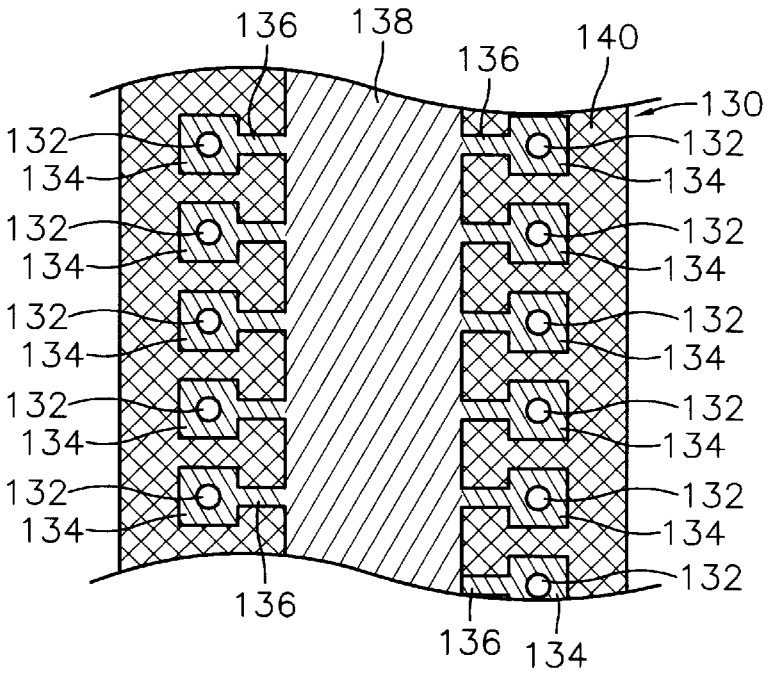
FIGS. 9 and 10 are a plan views of portions of masks which used to form nozzle plates according to the invention.
Figure 10:
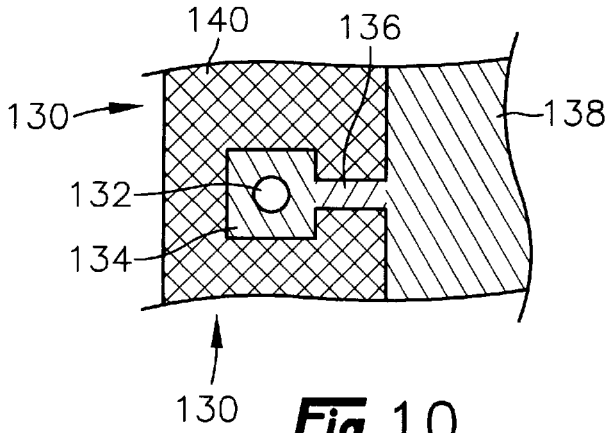

Multiple masks in combination with laser beam defocusing techniques may be used to produce a variety of nozzle plate flow feature designs. In the alternative, a single mask having a varying opacity from transparent to opaque may be used to reduce the manufacturing steps and time required to produce the nozzle plates. A particularly preferred mask is illustrated in FIGS. 9 and 10. In FIG. 10, the mask 130 (of varying opacity) contains transparent regions 132 which are used to ablate more than one feature such as nozzle holes in a polymeric material. Surrounding the transparent regions are semi-transparent regions 134 which are used to produce the firing chambers in the nozzle plate. Likewise, the supply channels are formed by semi-transparent regions 136 and the ink supply region is formed by semi-transparent region 138 which have either the same or more opacity than the firing chamber regions 134. The periphery 140 of the mask 130 around the flow features is substantially opaque so that little or no ablation of the polymeric material takes place outside of the firing chamber region 134, supply channel region 136 and ink supply region 138.

The semi-transparent and opaque regions of the mask 130 may be made by varying the shading of the mask by increasing the number of opaque lines and thus the gray scale shading of the mask in the regions where lower opacity is desired. Any of the methods known to those of skill in the art may be used to prepare the mask have semi-transparent and opaque regions. For example, the lines may be coated or printed onto the mask material or web made from metal or other material resistant to ablation by laser radiation.

Masks are typically made of quartz or other materials capable of transmitting uv light including calcium fluoride, magnesium fluoride and glass. The opaque regions may be formed from any metal capable of absorbing and/or reflecting uv light at the requisite wavelength, or it can be formed from a dielectric such as a metal oxide.

The side boundaries of the flow features ablated in the polymeric material are defined by the mask, which allows essentially full laser beam power to pass through holes or transparent regions of the mask and inhibits or reduces the laser beam energy reaching the polymeric material in the opaque and semi-transparent regions of the mask, respectively.

During the laser ablation process debris is formed from the polymeric material which, if not removed, may affect the performance of the nozzle plate. However, since the top layer of the polymeric material contains a sacrificial layer coated over the adhesive layer, any the debris lands on the sacrificial layer rather than on the underlying adhesive layer. After forming the nozzles, the sacrificial layer is removed.

The sacrificial layer is preferably a water soluble polymeric material, preferably polyvinyl alcohol, which may be removed by directing jets of water at the sacrificial layer until substantially all of the sacrificial layer has been removed from the adhesive layer. Since the sacrificial layer contains the debris, removal of the sacrificial will carry away the debris adhered to it. In this manner the polymeric material is freed of the debris which may cause structural or operational problems.

Having described the invention and preferred embodiments thereof, it will be recognized that the invention is capable of numerous modifications, rearrangements and substitutions of parts by those of ordinary skill without departing from the spirit and scope of the invention as defined by the appended claims.

What is claimed is:

1. A polymeric nozzle plate for a thermal ink jet printer comprising a polymeric material having thickness sufficient to provide a plurality of firing chambers, nozzle holes above each firing chamber and ink supply channels for feeding said firing chambers which are connected to an ink supply region having a plurality of projections sufficient to filter ink entering the supply channels, wherein each of said firing chambers has a firing chamber height, each of said supply channels has a supply channel height and the supply region has a supply region height wherein the firing chamber, supply channel and supply region heights are a fraction of the thickness of the polymeric material.

2. The nozzle plate of claim 1 wherein the nozzle holes have a substantially bell-shaped configuration.

3. The nozzle plate of claim 1 wherein each of said firing chambers and nozzle holes have a frustum conical shape.

4. The nozzle plate of claim 1 wherein the height of the ink supply region is greater than the height of the ink supply channel.

5. The nozzle plate of claim 1 wherein the height of the supply channels is from about 0.2 to about 4.0 times the height of the firing chambers.

6. A polyimide nozzle plate for a thermal ink jet printer comprising a polyimide material having a thickness sufficient to provide a plurality of firing chambers disposed adjacent opposed edges of the nozzle plate wherein said firing chambers have nozzle holes associated therewith and ink supply channels for feeding said firing chambers connected to an ink supply region having a plurality of projections sufficient to filter ink entering the supply channels and disposed adjacent opposed ink supply channels formed in the polyimide material, each of said nozzle holes having an entrance side adjacent the firing chamber and an exit side opposing the entrance side, wherein each of said firing chambers have a firing chamber height, each of said supply channels have a supply channel height and the supply region has a supply region height wherein the height of the supply region is greater than the height of the supply channels and the firing chambers.

7. The nozzle plate of claim 6 wherein the nozzle holes have a substantially bell-shaped configuration.

8. The nozzle plate of claim 6 wherein each of said firing chambers and nozzle holes have a frustum conical shape.

9. The nozzle plate of claim 6 wherein the height of the supply channels is from about 0.2 to about 4.0 times the height of the firing chambers.

* * * * *